US009486086B2

(12) United States Patent
Ranze

(10) Patent No.: US 9,486,086 B2
(45) Date of Patent: Nov. 8, 2016

(54) RECONFIGURABLE INFANT SUPPORT STRUCTURE

(71) Applicant: Mattel, Inc., El Segundo, CA (US)

(72) Inventor: Cole Micah Ranze, Holland, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/684,756

(22) Filed: Apr. 13, 2015

(65) Prior Publication Data

US 2015/0289675 A1 Oct. 15, 2015

Related U.S. Application Data

(60) Provisional application No. 61/979,164, filed on Apr. 14, 2014.

(51) Int. Cl.

| | |
|---|---|
| ***A47D 13/00*** | (2006.01) |
| ***A47D 1/10*** | (2006.01) |
| ***A47D 7/00*** | (2006.01) |
| ***A47D 7/04*** | (2006.01) |
| ***A47D 13/06*** | (2006.01) |
| ***A47D 9/02*** | (2006.01) |
| ***A47D 1/00*** | (2006.01) |
| ***A47D 9/00*** | (2006.01) |
| ***A47D 11/00*** | (2006.01) |
| ***A47D 13/10*** | (2006.01) |

(52) U.S. Cl.

CPC ..... *A47D 13/06* (2013.01); *A47D 1/00* (2013.01); *A47D 9/00* (2013.01); *A47D 11/005* (2013.01); *A47D 11/007* (2013.01); *A47D 13/102* (2013.01)

(58) Field of Classification Search

CPC ..... A47D 11/005; A47D 11/007; A47D 13/102; A47D 13/06; A47D 1/00; A47D 9/00

USPC ..... 297/1, 3, 118, 130, 256.16; 5/93.1, 5/99.1, 101

See application file for complete search history.

(56) References Cited

U.S. PATENT DOCUMENTS

| | | | | | |
|---|---|---|---|---|---|
| 12,357 | A | * | 2/1855 | Carpenter | A47C 13/00 297/3 X |
| 115,042 | A | | 5/1871 | Eaton | |
| 229,233 | A | * | 6/1880 | Behr | A47C 13/00 297/1 |
| 326,241 | A | * | 9/1885 | Preston | A47D 1/08 297/1 |
| 902,395 | A | | 10/1908 | Haley | |
| 1,326,415 | A | * | 12/1919 | Negus et al. | A47D 1/04 297/1 |
| 1,383,727 | A | | 7/1921 | Kohn | |
| 2,617,121 | A | | 11/1952 | Chatlos | |
| 2,720,253 | A | * | 10/1955 | Turner | A47B 3/06 5/101 X |
| 3,121,587 | A | * | 2/1964 | Bavaro | A47C 5/04 297/1 X |

(Continued)

*Primary Examiner* — Rodney B White

(74) *Attorney, Agent, or Firm* — Edell, Shapiro & Finnan, LLC

(57) ABSTRACT

A reconfigurable infant support structure is disclosed. The infant support structure includes a support frame and a seat. The support frame is movable between a first position and a second position. The first position may movably engage a support surface and the second position may statically engage a support surface. The seat is reconfigurable between a first configuration and a second configuration and may be moved between its first and second configurations when the seat is moved between the first and second positions. The seat may be provided in the first configuration when the frame is in the first position and the seat may be provided in the second configuration when the frame is in the second position. The support frame may be moved between its first and second positions by being flipped upside down.

20 Claims, 5 Drawing Sheets

(56) References Cited

U.S. PATENT DOCUMENTS 3,188,662 A * 6/1965 Watson ..... A47C 20/027 297/1
3,592,506 A * 7/1971 Breslow ..... A47D 1/04 297/1
3,650,563 A * 3/1972 Hansson ..... A47D 1/04 297/1
3,788,700 A * 1/1974 Wartes ..... A47B 3/00 5/93.1 X
3,794,379 A * 2/1974 Furey ..... B60N 2/2806 297/1
3,797,054 A * 3/1974 Sly ..... A47C 4/021 5/101
3,879,083 A * 4/1975 Olsson ..... A47D 1/04 297/1
3,972,559 A * 8/1976 Anacker ..... A47C 1/028 297/1
D248,516 S * 7/1978 Johansson ..... 297/1
4,164,356 A * 8/1979 Knight ..... A47C 1/028 297/1
4,205,876 A 6/1980 Cetina
4,561,692 A * 12/1985 Yestadt ..... A47B 9/00 297/1 X
4,735,455 A * 4/1988 Cuniberti ..... A47C 1/028 297/1
4,968,091 A * 11/1990 Mariol ..... A47D 1/103 297/3
5,016,301 A 5/1991 Combs
5,104,179 A * 4/1992 Jones ..... A47C 3/029 297/3 X
D332,532 S 1/1993 Combs
D341,031 S 11/1993 Burkhart
5,382,072 A * 1/1995 Diefenbach ..... A47D 1/08 297/1
5,440,770 A * 8/1995 Nichols ..... A47D 1/00 5/424
5,690,379 A * 11/1997 Cayssials ..... A47D 1/08 297/1
6,131,218 A * 10/2000 Wang ..... A47D 13/06 5/93.1
6,367,874 B2 * 4/2002 Casini ..... A47D 1/04 297/3 X
7,350,253 B2 * 4/2008 Simon ..... A47D 7/002 5/101 X
8,341,782 B2 * 1/2013 Abrahams ..... A47D 1/00 297/452.11
8,870,277 B2 * 10/2014 Yestadt ..... A47C 3/00 297/1
2006/0192414 A1 * 8/2006 Berkes ..... A47D 1/08 297/3
2006/0214476 A1 * 9/2006 Rojas ..... A47C 4/30 297/3
2008/0236452 A1 10/2008 Pratt et al.
2009/0106894 A1 4/2009 Yeo
2009/0193582 A1 8/2009 Kummerfeld et al.
2010/0229300 A1 * 9/2010 Eirich ..... A47D 9/00 5/93.1
2011/0148155 A1 6/2011 Chapman
2012/0274105 A1 11/2012 Chen et al.
2013/0214574 A1 8/2013 Chapman et al.
2016/0120325 A1 * 5/2016 Paoletti ..... A47C 1/146 297/118

* cited by examiner

RECONFIGURABLE INFANT SUPPORT STRUCTURE

CROSS-REFERENCE TO RELATED APPLICATIONS

This application claims priority to and the benefit of U.S. Provisional Patent Application No. 61/979,164, filed Apr. 14, 2014, entitled "Reconfigurable Infant Support Structure," the contents of which is hereby incorporated by reference in full.

FIELD OF THE INVENTION

The present invention is directed toward an infant support structure and, in particular, to a reconfigurable infant support structure which may be repositioned between at least two different infant support configurations.

BACKGROUND OF THE INVENTION

Infant support structures are used to support an infant or child. Typically, infant support structures include a frame and a seat or support portion that an infant or child can be placed in or on, such that a child can be safely and securely kept in a certain place or position. Some infant support structures, such as seats and entertainers, provide a configuration that supports a child in an upright position, perhaps for play or feeding, while other infant support structures, such as rockers and swings, provide a configuration that supports a child in a recline position in order to soothe a child and induce sleep. Still other support structures, such as bassinets, provide configurations that are designed to provide a sleeping/play space for a child. In light of these different functions, parents are frequently required to purchase and store multiple infant support structures and, typically, each of these support structures takes up a considerable amount of space in a home. This is particularly problematic in urban environments, where space is at a premium. For at least these reasons, an infant support structure that is reconfigurable between multiple infant support structure configurations is desired.

SUMMARY OF THE INVENTION

The present invention generally relates to a reconfigurable infant support structure. According to at least one exemplary embodiment, an infant support structure according to the present invention includes a support frame configured to engage a support surface in a first position and a second position and a seat extending within the support frame. The seat is reconfigurable between a first configuration and a second configuration. The seat is provided in its first configuration when the support frame is engaging the support surface in the first position and the seat is provided in its second configuration when the support frame is engaging the support surface in the second position.

In some embodiments of this infant support structure, the support frame includes a first leg, a second leg spaced a distance from the first leg, and at least one connector extending therebetween, such that the seat is disposed between the first leg and the second leg. In some of these embodiments, the at least one connector includes four connectors and each connector is disposed proximate a corner of the support frame. The seat is coupled to the support frame via the four connectors in such embodiments.

In other embodiments, the first leg and second leg each include a first portion and a second portion spaced a distance from the first portion. The first portion engages the support surface in the first position and the second portion engages the support surface in the second position. In some of these embodiments, the support frame statically engages the support surface in the first position and permits the infant support structure to move relative to the support surface in the second position.

In some embodiments of this infant support structure, the first configuration is a bassinet configuration and the second configuration is a rocker configuration. Moreover, in some embodiments, the infant support structure may be moved between the first position and the second position when the support frame is flipped upside down.

BRIEF DESCRIPTION OF THE DRAWINGS

Like reference numerals have been used to identify like elements throughout this disclosure.

DETAILED DESCRIPTION OF THE INVENTION

In accordance with the present invention, a reconfigurable infant support structure is disclosed. Generally referring to the figures, a reconfigurable infant support structure is an infant support structure that may move between a first position and second position in order to move a seat included therein between a first configuration and a second configuration. Preferably, the infant support structure is moved from its first position to its second position by being flipped upside down. Moreover, the infant support structure is preferably statically supported on a support surface when disposed in the first position, insofar as the infant support structure is not configured to rock or sway on the support surface, but movably supported on a support surface when in the second position, insofar as movably supported indicates that the support structure may permit movement with respect to the support surface when engaged with support surface in this manner. For example, the infant support structure may rest on an arcuate base when in the second position so that the infant support structure may rock back and forth when disposed in the second position.

Still referring generally to the figures, the first configuration, which may be alternately referred to as a bassinet configuration, play yard configuration, or first sleeper configuration, may provide a receptacle with a flat bottom and four walls, so that an infant may rest, sleep, or play in a at least a supine or prone position, as desired. This configuration may also allow an infant to stand and lean on a top railing, if desired. In contrast, the second configuration, which may be alternately referred to as a rocker configuration, second sleeper configuration, or sling configuration, may provide a receptacle which receives an infant in a reclined, supine position. Since the infant support structure preferably provides the second configuration when disposed in the second position, an infant may be rocked back in forth while lying in the receptacle provided by the second configuration. By comparison, the bassinet configuration (i.e. the first configuration) is preferably provided while the infant support structure is in the first position, and thus, the infant support structure may not be rockable while in the bassinet configuration. However, in other embodiments, the first and second configurations may provide a receptacle of any shape and size and each configuration may be provided when the infant support structure is in any desirable position.

Figure 1:
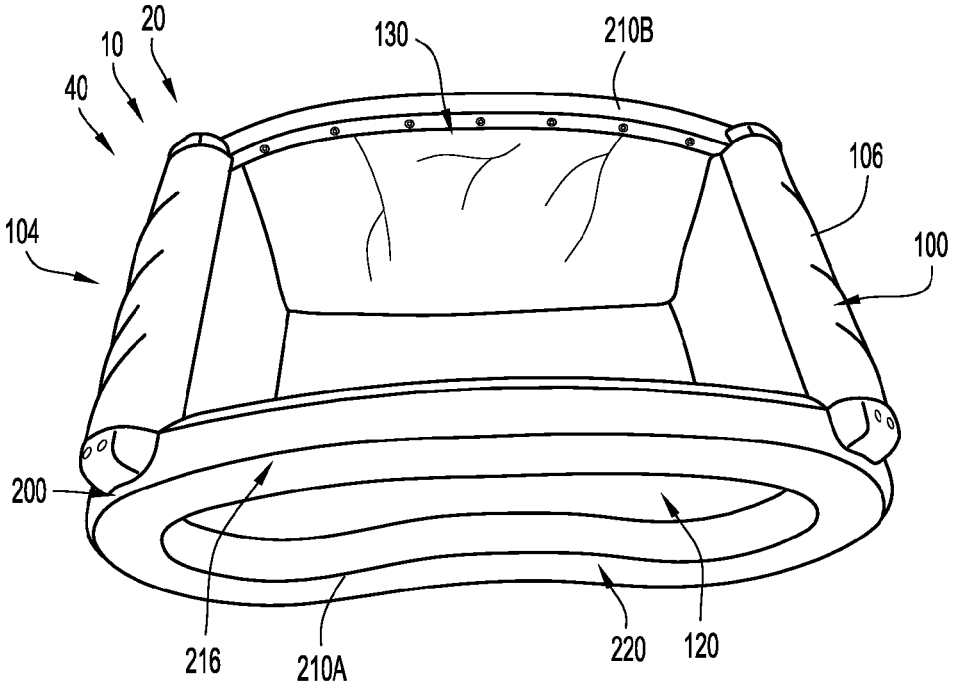
FIG. 1 shows a top perspective view of an exemplary embodiment of a reconfigurable infant support structure in a first position, the infant support structure including a seat suspended between two legs in a first configuration.
Figure 2:
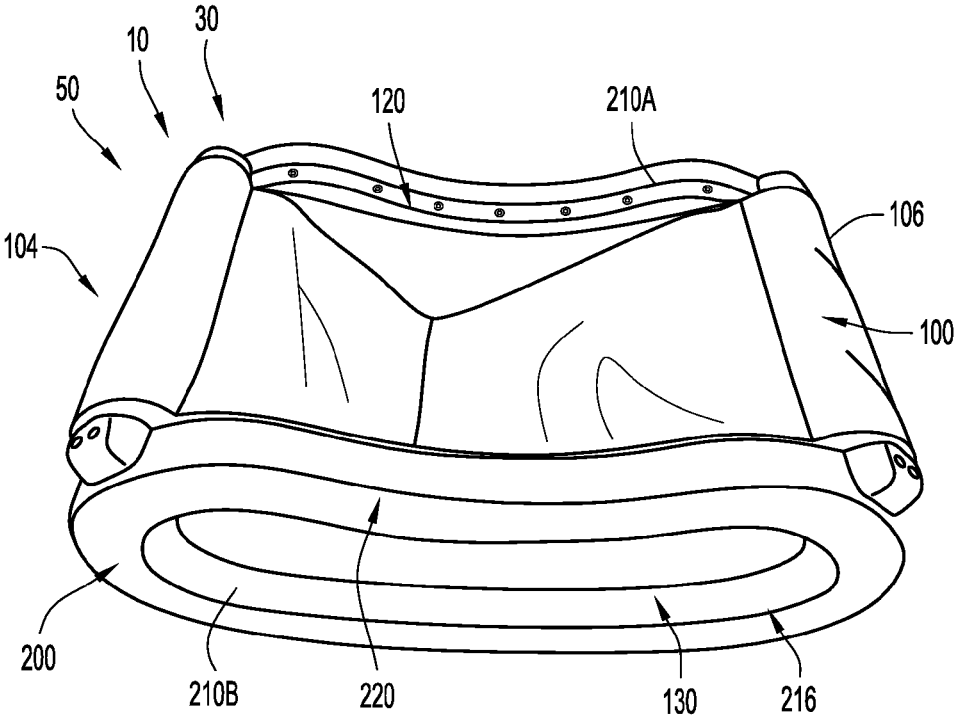
FIG. 2 shows a top perspective view of the infant support structure of FIG. 1 in a second position with the seat in a second configuration.

Now referring to FIGS. 1-2, one exemplary embodiment of a reconfigurable infant support structure 10 according to the present invention is shown in a first position 20 and a second position 30, respectively. As can be seen, in this particular embodiment, the infant support structure 10 includes a seat or child receiving portion 100 that is mounted on a support frame 200 which includes two legs, leg 210A and leg 210B, that are preferably either identical or mirror images of each other. However, since each leg 210A, 210B is preferably substantially the same, the features of legs 210A and 210B may be described herein with respect to only one of leg 210A or 210B, with the understanding that each leg 210A, 210B includes the same features. As an example, in FIG. 1, leg 210A is shown to have a first portion 216 and a second portion 220 that are each configured to selectively engage a support surface and it is to be understood that leg 210B also includes these portions, as seen in FIG. 2.

Portions 216 and 220 allow the infant support structure 10 to rest on a support surface in at least two distinct positions—first position 20 and second position 30. As shown in FIGS. 1-2, in this embodiment, each portion 216, 220 extends arcuately between a first end 104 and a second end 106 of the infant support structure 10 and portion 216 is spaced a distance from portion 220. Thus, when the first portion 216 is resting on a support surface (i.e., the infant support structure is in the first position 20), the second portion 220 is spaced a distance from the support surface, and vice versa. Additionally, this arrangement allows the infant support structure 10 to be moved between position 20 and position 30 by simply flipping the infant support structure 10 (or merely the support frame 200) upside down (i.e. rotated 180 degrees about one of its ends or a horizontal axis).

In this embodiment, the support frame 200 includes tube-like members, such that each portion 216 and 220 is included on a different portion of a single tubular member used for leg 210A. However, in other embodiments, support frame 200 may be any desirable shape and size and portions 216 and 220 may be included on any desirable portion of support frame 200. Moreover, in this particular embodiment, portion 216 is substantially parallel to portion 220. In order to provide arcuate, parallel portions, first portion 216 is substantially convex and second portion 220 is substantially concave. Consequently, when the first portion 216 engages a support surface the infant support structure 10 may be able to rock on the support surface, but when the second portion 220 engages a support surface, the infant support structure 10 may be prevented from rocking and the infant support structure may be substantially static. In other embodiments, the support frame 200 may include any desirable portions, supports, or members configured to allow the infant support structure 10 to rest upon a support surface in two distinct positions, but preferably, the support frame 200 provides at least one position that can (i.e., is permitted to) movably engage a support surface and at least one position that can statically engage a support surface.

Still referring to FIGS. 1-2, the seat 100 is mounted within the support frame 200. Specifically, the seat 100 includes a first side 120 adjacent the first leg 210A, a second side 130 adjacent leg 210B, and extends from the first end 104 to the second end 106. Additionally, the seat 100 is configured to move between a first configuration 40 and a second configuration 50. Preferably, the seat 100 is configured to provide the first configuration 40 when the infant support structure 10 is disposed in the first position 20 and the seat 100 is configured to provide the second configuration 50 when the infant support structure 10 is disposed in the second position 30. However, in other embodiments, the infant support structure may move between configurations 40 and 50 as desired. In this particular embodiment, the seat 100 provides as a bassinet structure when in the first configuration 40 and the seat 100 provides a reclined sling suitable for a rocker when in the second configuration 50.

Since, in this embodiment, the seat 100 is configured to provide the first configuration 40 when in the first position 20 and the second configuration 50 when in the second position 30, the first configuration 40 may be provided on a static base while the second configuration 50 may be provided on a movable base. In other words, placing the infant support structure 10 in the first configuration 40 and first position 20 may provide a static bassinet and placing the infant support structure 10 in the second configuration 50 and second position 30 may provide a movable (i.e., rockable) rocker, which may be referred to simply as a rocker. Consequently, in this embodiment, a parent may reconfigure the infant support structure 10 between a static bassinet and a rocker by simply flipping the infant support structure 10 upside down (i.e., rotating the support structure 180 degrees about a horizontal axis).

Figure 3:
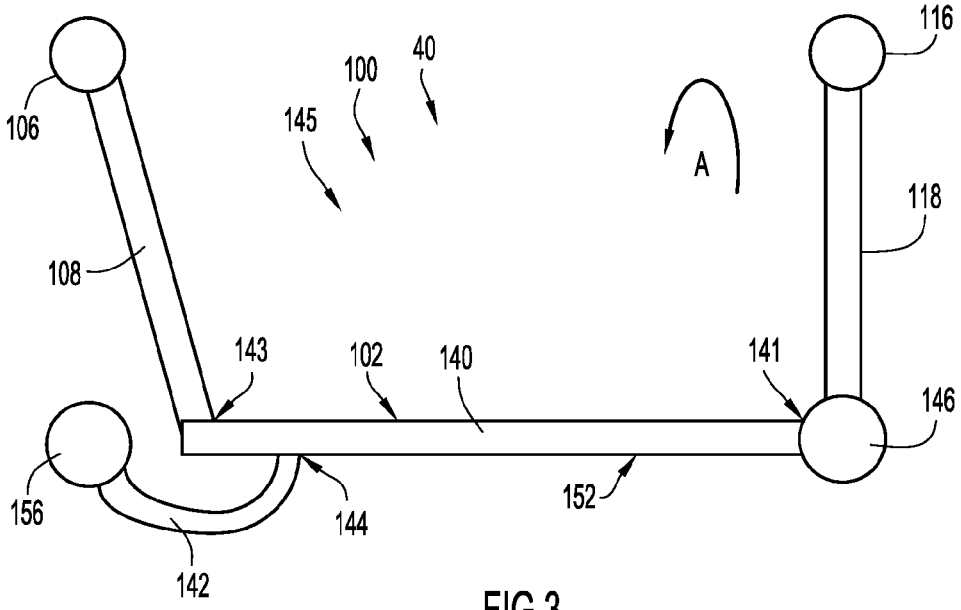
FIGS. 3-4 show schematic diagrams of a sectional, side perspective view of the seat of FIG. 1 in the first configuration and second configuration, respectively.
Figure 4:
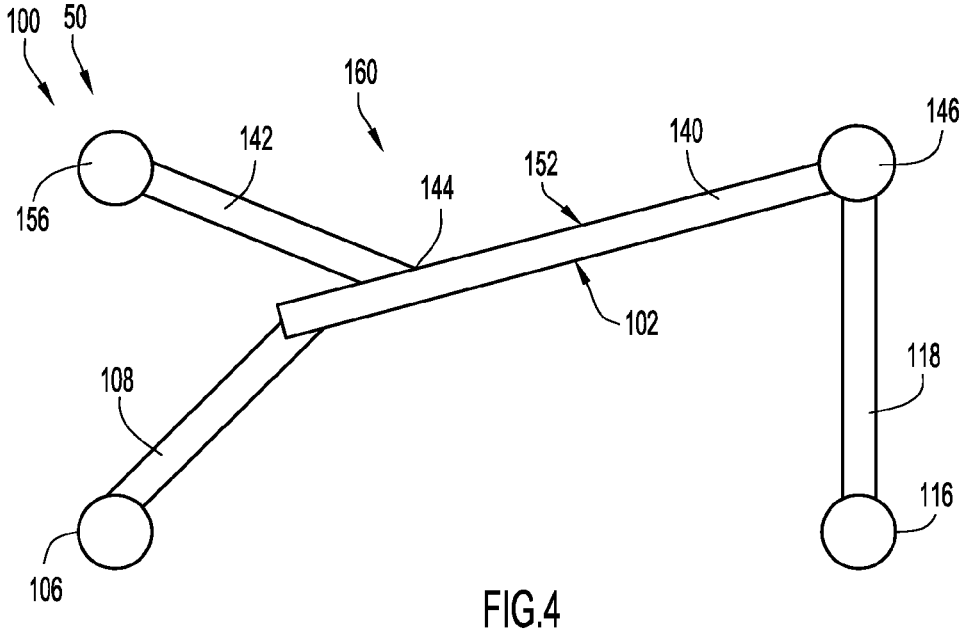

Now turning to FIGS. 3-4, the seat 100 is shown in schematic diagrams which depict the seat 100 from a side, sectional view while removed from the support frame 200. As shown, the seat 100 includes a bottom 140, a first end wall 108, a second end wall 118, and a flap 142. The bottom 140 extends between a first end 141 that is proximate wall 118 and a second end 143 that is proximate wall 108. The bottom 140 also includes a first surface 102 and a second surface 152, the second surface 152 being opposite the first surface 102. Additionally, the seat 100 includes four mounts, first mounts 106 and 116 and second mounts 146 and 156. Preferably each of the components of seat 100 (the walls 108, 118, 122, 132, bottom 140, flap 142 and mounts 106, 116, 146, 156) is manufactured, at least in part, from a softgoods materials. Thus, each of the walls 108, 118, 122, 132 may simply hang (in the direction influenced by gravity) between the portions of seat 100 it extends between. However, in some embodiments, such as the embodiment shown herein, the bottom 140 may also include a hardgoods insert in order to increase the stability and firmness of bottom 140 and prevent the bottom 140 from bending.

Still referring to FIGS. 3-4, each of the mounts 106, 116, 146, 156 may be coupled to a portion of the support frame 200, as is described below in detail. Accordingly, each of the mounts 106, 116, 146, 156 is fixed with respect to the support frame 200 when mounted therein, but the remainder of the seat 100 may be movable about or around these mounts. In order to allow the seat 100 to be movable, at least some of the walls 108,118, 122, 132, bottom 140, and flap 142 include a free end that is not coupled to one of the mounts 106, 116, 146, 156. Most notably, in this embodiment, the second end 143 of bottom 140 is not coupled directly to a mount. Instead, the second end 143 of bottom 140 is coupled to mount 106 via wall 108 and the second surface 152 of bottom 140 is coupled to mount 156 via the flap 142 at a point 144 between the second end 143 and the midpoint of bottom 140. Preferably, flap 142 and wall 108 collectively span a length longer than the direct distance between mounts 106 and 156 and, thus, the above-described connections may allow bottom 140 to move to different positions when oriented in different positions.

Figure 6:
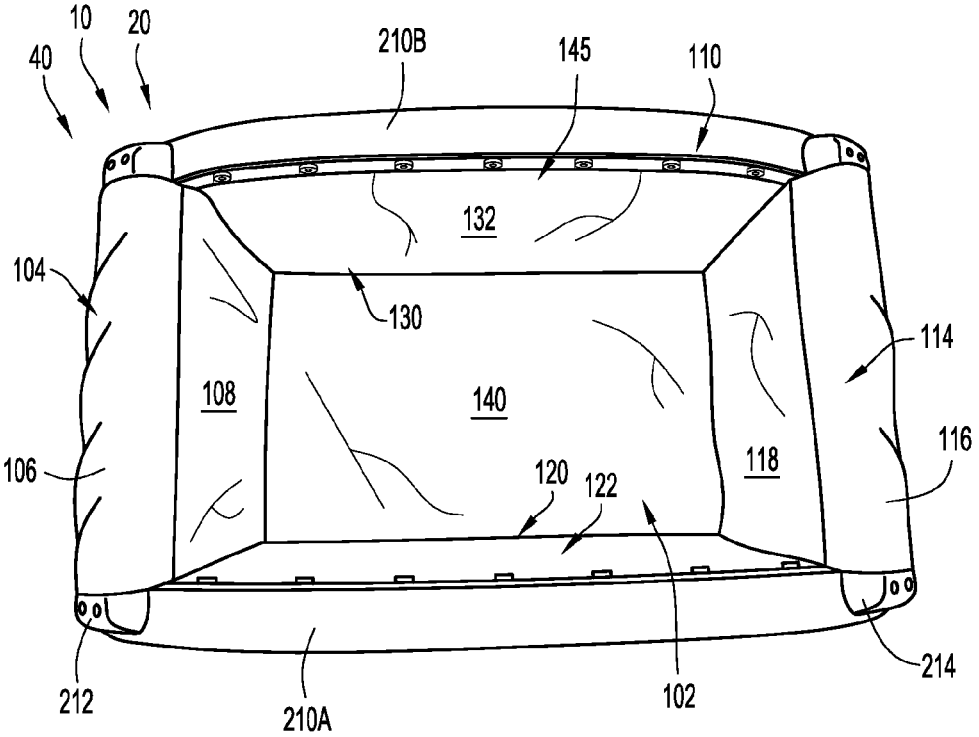

As shown in FIG. 3, the seat 100 is in a first configuration 40 when mounts 106 and 116 are disposed above mounts 156 and 146. In this configuration, walls 108 and 118 (as well as walls 122 and 132, as shown in FIG. 6) hang downwards and stretch to their full length. Thus, wall 108, wall 118, and the first surface 102 of bottom 140, together with walls 122 and 132 (see FIG. 6) collectively form a first receptacle 145. Preferably, each of the walls 108, 118, 122, 132 is the same length so that the bottom 140 extends substantially horizontally therebetween. Additionally, in this configuration, the flap 142 hangs between the bottom 140 and mount 156, but does not stretch to its full length.

In order to move the seat 100 from configuration 40 to configuration 50, mounts 146 and 156 may be moved above mounts 106 and 116, perhaps by flipping the seat upside down in direction "A," to the position shown in FIG. 4. Once disposed in configuration 50, gravity will cause the flap 142 to stretch to its full length and support the bottom 140 in a slanted or sloped position, such that flap 142 and second surface 152 collectively form a V-shaped surface with an apex at point 144. Additionally, together with walls 126 and 136 (see FIG. 9), the second surface 152 and flap 142 may form a second receptacle 160 which is preferably smaller than first receptacle 145. Consequently, a parent may easily reconfigure the seat 100 between a configuration 40 which provides a first receptacle 145 and a second configuration 50 which provides a second receptacle 160 by simply flipping the seat 100 upside-down.

Figure 5:
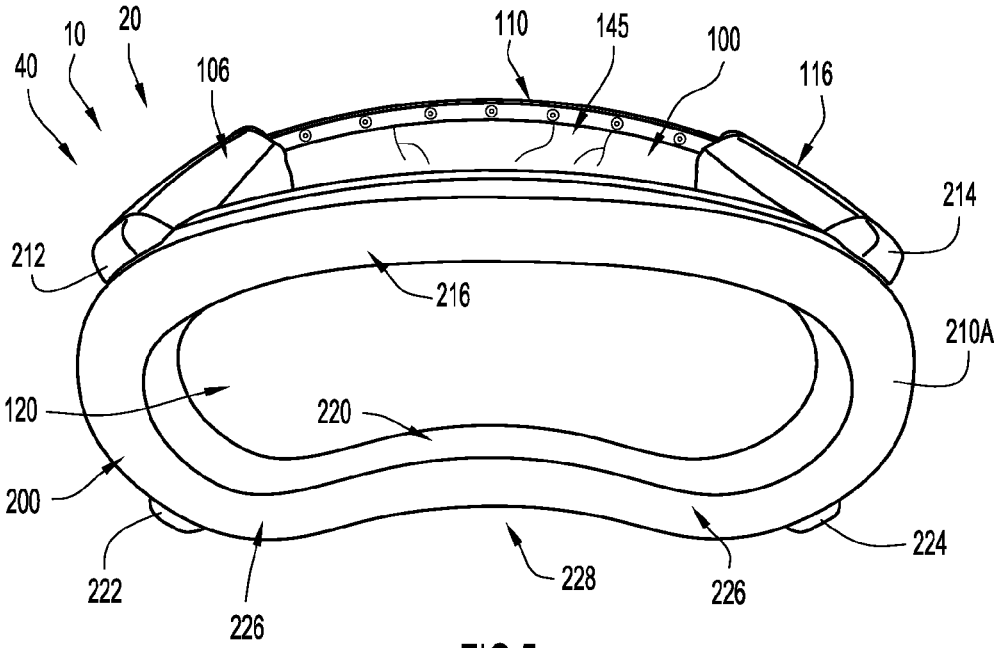
FIGS. 5-6 show a side and a top perspective view, respectively, of the infant support structure of FIG. 1 in the first position and first configuration.

Now turning to FIGS. 5-6, the infant support structure 10 is shown from a side and top perspective, respectively, with the support frame 200 in the first position 20 and the seat in the first configuration 40. As can be seen best from these views, in addition to legs 210A, 210B, the support frame 200 also includes connectors 212, 214, 222, and 224. Each of these connectors extends between legs 210A and 210B and is configured to receive a mount 106, 116, 146, 156 of the seat 100. For example, each mount 106, 116, 146, 156 may be wrapped around the connectors 212, 214, 222, 224. In the present embodiment, each mount 106, 116, 146, 156 is a cylindrical fabric sleeve that is installed onto its respective connector 212, 214, 222, 224 before the connector 212, 214, 222, 224 is coupled to the both of the legs 210A, 210B. Accordingly, the seat 100 is fixedly coupled to the support frame 200 at four points, regardless of the seat's configuration or the support frame's position, so that the seat 100 is suspended within the support frame 200. Preferably, the connectors 212, 214, 222, 224 are disposed at each corner of the support frame, insofar as corner simply denotes outer locations along the first and second portions 216, 220 of the support frame. Such a location is preferred as it allows the seat 100 to extend over the largest area within the support frame 200.

Figure 8:
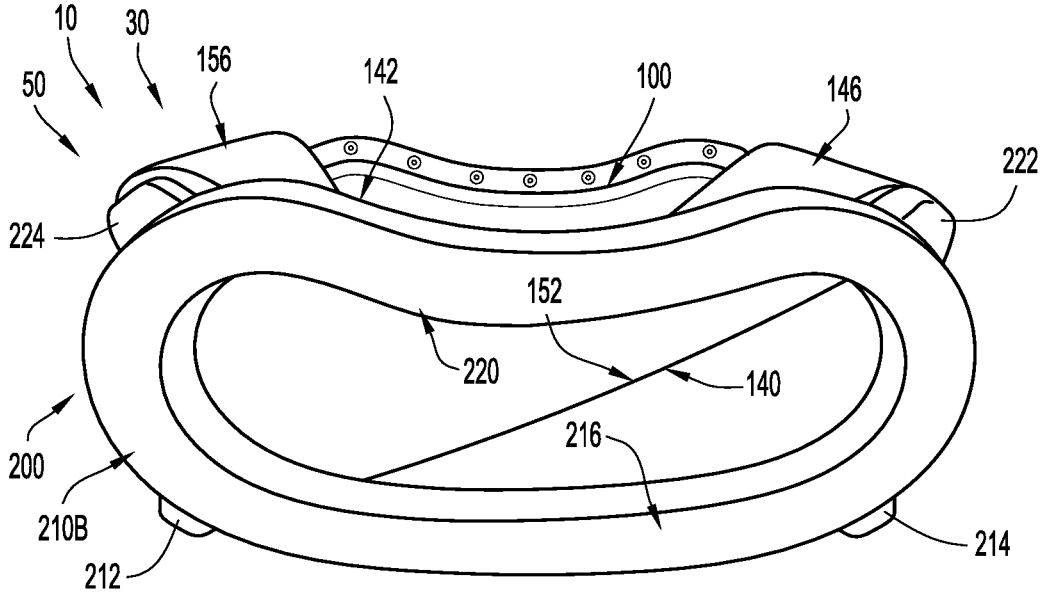
FIGS. 8-9 show a side and front perspective view, respectively, of the infant support structure of FIG. 1 in the second position and second configuration.

Additionally, as can be seen best in FIGS. 5 and 8, positioning the connectors 212, 214, 222, 224, in such a location also allows the connectors 212, 214, 222, 224 to act as stops to either prevent movement or restrict movement to a certain range. For example, as can be seen in FIG. 5, when the infant support structure 10 is disposed in the first position 20, the second portion 220 is engaging the support surface. Due to its concave shape, second portion 220 provides ground engaging portions 226 on either side of a gap 228. However, in other embodiments, the second portion 220 may simply include one, flat surface, such that there is no gap 228. Regardless, the connectors 222 and 224 may also engage the support surface and assist the ground engaging portions 226 in preventing the infant support structure from moving. However, in some embodiments, the ground engaging portions 226 may be sufficient to prevent any movement without assistance from the connectors 222, 224. In other words, the ground engaging portions 226 of surface 220 may, either together with connectors 222, 224 or alone, provide support frame 200 with a static base.

Still referring to FIGS. 5-6, and as mentioned above, when the seat is disposed in the first configuration 40, each of the walls 108, 118, 122, 132 may hang downwards from mounts 106 and 116, as can be seen best in FIG. 6. The end walls 108, 118 are coupled directly to the mounts 106 and 116 and the side walls 122, 132 are coupled to the mounts via the end walls 108, 118. However, in order to prevent a child from getting stuck in gaps between the seat 100 and support frame 200, at least a portion of a first side 120 of the seat 100 is preferably mounted to leg 210A and at least a portion of a second side 130 of seat 100 is preferably mounted to leg 210B, such that the seat 100 extends substantially between legs 210A and 210B without any gaps therein. In this particular embodiment, walls 108, 118, 122, and 132 collectively form a top edge 110, and each of the portions of edge 110 adjacent side walls 122 and 132 is coupled to its respective adjacent leg 210A, 210B. Accordingly, the seat 100 spans the entire area between connectors 212 and 214 and legs 210A and 210B, leaving no gaps for a child to get stuck in. However, in other embodiments, the seat 100 may extend over any portion of the support frame 200, as desired.

Figure 9:
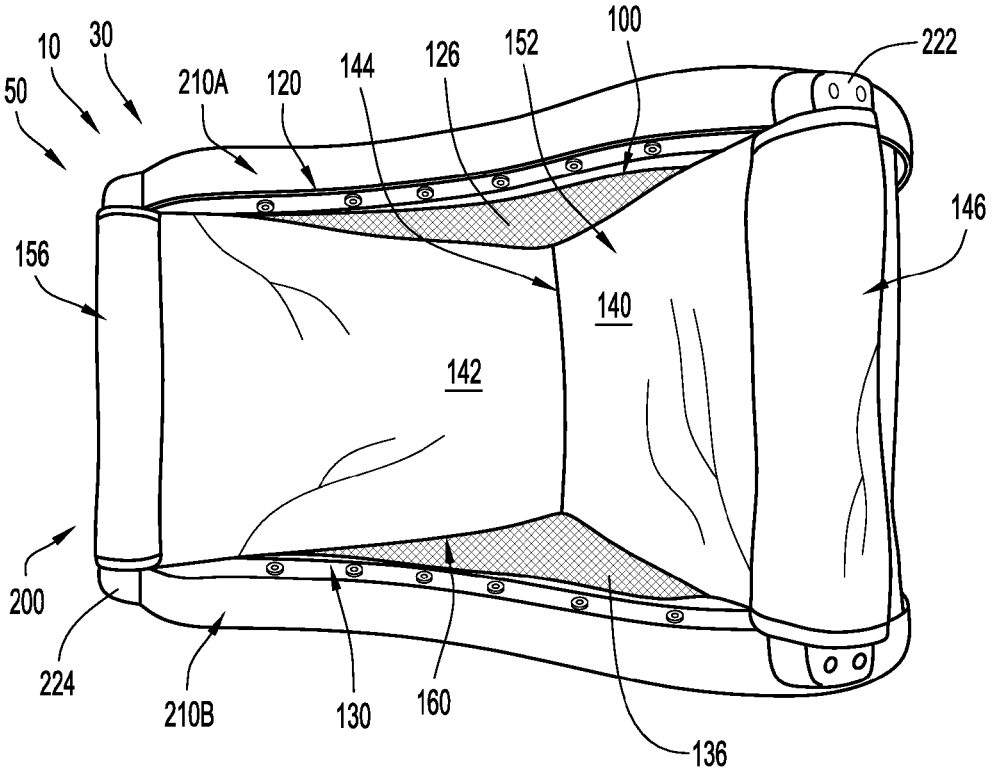
Figure 10:
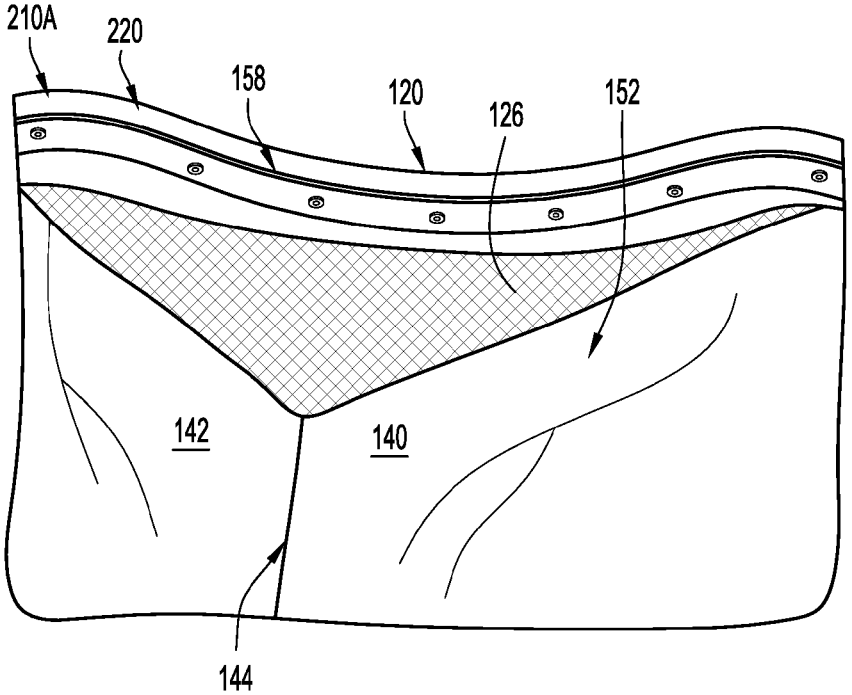
FIG. 10 shows a portion of the infant support structure seen in FIG. 9.

Similarly, when the seat 100 is moved to its second configuration 50, the seat also spans the entire area within support frame 200 in order to ensure no gaps are provided between the seat 100 and support frame 200 when seat 100 is in the second configuration 50, as seen in FIGS. 8-10. In particular, the seat 100 includes a first side wall 126 and a second side wall 136. As shown in the close-up view of FIG. 10, side wall 126 extends between the second surface 152 of bottom 140, the flap 142 and leg 210 along side 120 of seat 100. The wall 126 also includes a top edge 158, which similar to edge 110, is coupled to leg 210A in order to ensure no gaps are provided between seat 100 and support frame 200. Although not shown explicitly, it is to be understood that wall 136 also includes similar features to the aforementioned features of wall 126 which are disposed adjacent to leg 210B on side 130.

Figure 7:
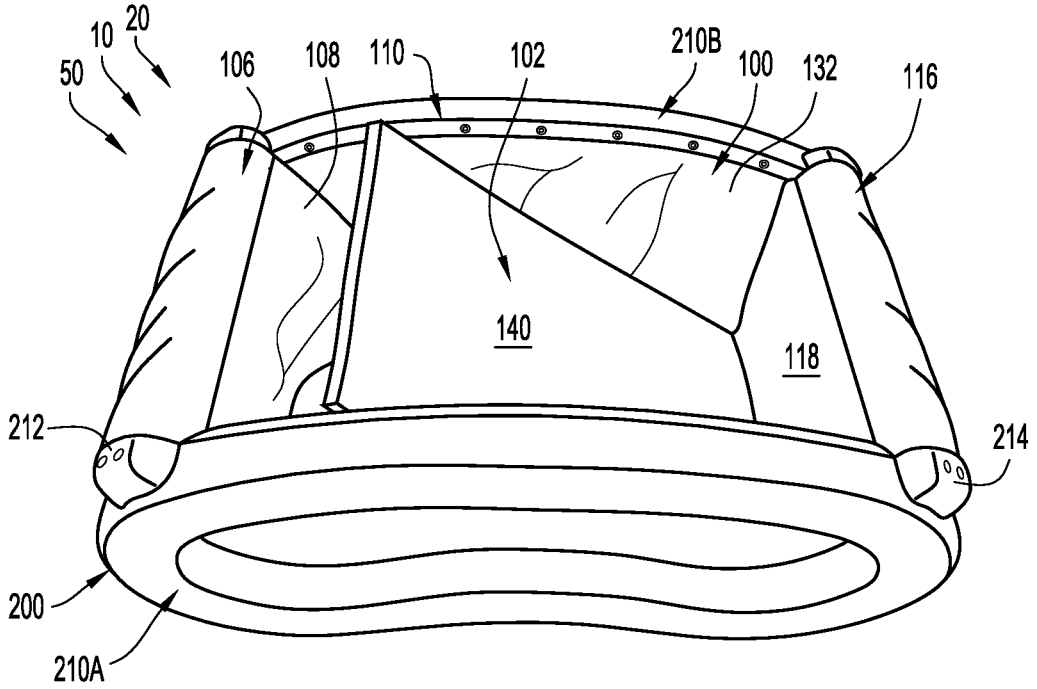
FIG. 7 shows a top perspective view of the infant support structure of FIG. 1 in the first position and between the first and second configurations.

Still referring to FIGS. 8-10, but now with reference to FIG. 7 as well, in the illustrated embodiment, the seat 100 moves to its second configuration 50 when the support frame 200 is moved to its second position 30. When the support frame 200 is moved to its second position 30, the bottom 140 naturally sags until the flap 142 is fully extended and holds the bottom 140 in a slanted or sloped position. Thus, as shown in FIG. 7, which is a top view of the infant support structure in the first position 20 but second configuration 50, wall 108 substantially folds or collapses when the flap 142 is fully extended. Thus, both the flap 142 and bottom 140 may provide substantially linear surfaces such that a substantially V-shaped receptacle 160 is provided. However, as mentioned above, the bottom 140 preferably includes a hardgoods insert so the bottom 140 remains fully extended and at least somewhat stiff, while the flap 142 is preferably simply a softgoods panel. Thus, the bottom 140 may remain substantially linear even when an infant is placed therein, while the flap 142 may conform to the infant's body. Accordingly, it may be preferred to place an infant's torso on the bottom 140 and the infant's legs on the flap 142 to maximize comfort.

Now referring generally to FIGS. 1-10, the infant support structure 10 of the present invention may be used in either its first position 20 or its second position 30. The infant support structure 10 preferably provides a first configuration 40 when in its first position 20 and a second configuration 50 when in its second position 30 and may shift between these configurations without requiring any parent interaction. In other words, the infant support structure 10 may shift between configurations 40 and 50 automatically or naturally, insofar as automatically and naturally each implies that that no parent interaction is required. In this particular embodiment, the infant support structure is reconfigured due to gravitational forces urging the seat in different directions when the infant support structure is oriented in different positions (i.e. position 20 or position 30).

In light of the above, by simply moving the infant support structure 10 from its first position 20 to its second position 30, a parent may reconfigure the infant support structure 10. Preferably, a parent may simply flip the infant support structure upside-down in order to reconfigure the infant support structure 10, as described above. However, in various embodiments, any desirable movement may serve to reconfigure the infant support structure 10. Additionally, while the first and second configurations 40, 50 have been described as a bassinet and rocker, it is to be understood that the first and second configuration 40, 50 may each be any desirable infant support structure configuration, and may even be the same or only slightly different configurations. For example, in some embodiments, the first configuration 40 may provide a bassinet themed for boys and the second configuration 50 may provide a bassinet themed for girls. Regardless, a simple position movement may allow the parent to reconfigure the infant support structure between these two configurations.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the infant support structure of the present invention, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

What is claimed:

1. An infant support structure comprising:

a support frame configured to engage a support surface in either a first position or a second position; and a seat extending within the support frame, the seat being reconfigurable between a first configuration and a second configuration, wherein the seat is provided in its first configuration when the support frame is engaging the support surface in the first position and the seat is provided in its second configuration when the support frame is engaging the support surface in the second position, and wherein the seat automatically shifts from the first configuration to the second configuration due to gravitational forces urging the seat in a different direction when the infant support structure is reoriented from the first position on the support surface to the second position on the support surface.

2. The infant support structure of claim 1, wherein the support frame further comprises:

a first leg;

a second leg spaced a distance from the first leg; and at least one connector extending therebetween; wherein the seat is disposed between the first leg and the second leg.

3. The infant support structure of claim 2, wherein the at least one connector comprises:

four connectors, each connector being disposed proximate a corner of the support frame and the seat being coupled to the support frame via the four connectors.

4. The infant support structure of claim 2, wherein the first leg and second leg each comprise:

a first portion; and a second portion spaced a distance from the first portion, the first portion engaging the support surface in the first position and the second portion engaging the support surface in the second position.

5. The infant support structure of claim 1, wherein the support frame statically engages the support surface in the first position and permits movement of the infant support structure with respect to the support surface in the second position.

6. The infant support structure of claim 1, wherein the first configuration is a bassinet configuration and the second configuration is a rocker configuration.

7. The infant support structure of claim 1, wherein the infant support structure may be moved between the first position and the second position by being flipped upside-down.

8. An infant support structure comprising:

a support frame that is movable between a first position and a second position; and a child receiving portion configured to automatically shift between a first configuration and a second configuration as the support frame is moved between the first position and the second position due to gravitational forces urging the child receiving portion in a different direction, wherein moving the support frame from the first position to the second position causes the child receiving portion to be reconfigured from the first configuration to the second configuration and moving the support frame from the second position to the first position causes the child receiving portion to be reconfigured from the second configuration to the first configuration.

9. The infant support structure of claim 8, wherein the child receiving portion is mounted to the support frame with one or more mounts and free to move about the mounts within the support frame.

10. The infant support structure of claim 8, wherein the support frame further comprises:

a pair of legs, each leg including a first portion and a second portion, wherein the first portion of each leg engages a support surface in a manner that permits movement when the infant support structure is in the first position and the second portion of each leg statically engages the support surface when the infant support structure is in the second position.

11. The infant support structure of claim 8, wherein the first configuration provides a first receptacle and the second configuration provides a second receptacle, the first receptacle being smaller than the second receptacle and the first and second receptacles each being configured to receive a child.

12. The infant support structure of claim 11, wherein the first receptacle provides a V-shaped receptacle and the second receptacle includes four walls and a flat bottom.

13. The infant support structure of claim 11, wherein the first receptacle provides a reclined seat and the second receptacle provides a play space.

14. A softgoods seat for a reconfigurable infant support structure comprising:

a wall including a first end and a second end, the first end including a first mount coupleable to a support frame of an infant support structure;

a bottom portion coupled to the second end of the wall, wherein the bottom portion includes a first surface configured to receive a child and second surface configured to receive a child, the second surface being opposite the first surface;

a flap including a first end coupled to the second surface of the bottom portion and a second end including a second mount coupleable to the support frame, wherein, subsequent to being mounted to the infant support structure via the first and second mounts, the seat is configured to provide a first configuration when the infant support structure is oriented in a first position with respect to a support surface and the seat is configured to provide a second configuration when the infant support structure is oriented in a second position with respect to the support surface.

15. The softgoods seat of claim 14, wherein the bottom portion is coupled to the second end of the first wall at a first end, the bottom portion further comprising:

a third mount disposed at a second end of the bottom portion, the third mount being coupleable to the infant support structure, the seat being configured to provide the first and second configuration subsequent to being mounted to the infant support structure via the first, second, and third mounts.

16. The softgoods seat of claim 14, wherein the flap is coupled to the second surface of the bottom portion at a point between the joint with the first wall and a midpoint of the length of the bottom portion.

17. The softgoods seat of claim 14, wherein, when the first and second mount are mounted to the infant support structure, the first and second mounts are fixed with respect to the infant support structure, but the remainder of the softgoods seat is movable about the first and second mounts.

18. The softgoods seat of claim 14, wherein the first wall is fully extended when the seat is in its first configuration and the flap is fully extended when the seat is in it the second configuration.

19. The softgoods seat of claim 18, wherein, in the first configuration, the flap and bottom portion provide a V-shaped receptacle and, in the second configuration, the wall and bottom portion define two sides of a cuboidal receptacle.

20. The softgoods seat of claim 14, wherein the bottom portion further comprises:

a hardgoods insert configured to maintain the shape of the bottom portion.

* * * * *